US005307821A

United States Patent [19]

Misuda et al.

[11] Patent Number: 5,307,821

[45] Date of Patent: May 3, 1994

[54] TOBACCO RAW MATERIAL AND METHOD FOR ITS PRODUCTION

[75] Inventors: Katsutoshi Misuda, Yokohama; Hitoshi Kijimuta, Ebina; Kouichi Numata, Yokohama; Masaharu Tanaka, Yokohama; Yoshinori Katayama, Yokohama; Iku Tomari, Yokohama; Toshiro Samejima, Tokyo, all of Japan

[73] Assignees: Asahi Glass Company Ltd.; Japan Tobacco Inc., Tokyo, Japan

[21] Appl. No.: 691,497

[22] Filed: Apr. 25, 1991

[30] Foreign Application Priority Data

Apr. 27, 1990 [JP] Japan ..... 2-110409
Apr. 27, 1990 [JP] Japan ..... 2-110410
Jan. 23, 1991 [JP] Japan ..... 3-22887

[51] Int. Cl.[5] ..... A24B 15/10
[52] U.S. Cl. ..... 131/290; 131/359
[58] Field of Search ..... 131/290, 309, 331, 347, 131/359, 335, 343

[56] References Cited

U.S. PATENT DOCUMENTS 1,808,707 6/1931 Wiggins ..... 131/331
2,007,407 7/1935 Sadtler ..... 131/331
4,915,117 4/1990 Ito .
5,017,354 5/1991 Simms et al. .

OTHER PUBLICATIONS

Condensed Chemical Dictionary, Tenth Edition, 1977 p. 266.

*Primary Examiner*—V. Millin
*Assistant Examiner*—J. Doyle
*Attorney, Agent, or Firm*—Birch, Stewart, Kolasch & Birch

[57] ABSTRACT

The present invention relates to a method for producing a tobacco raw material having at least a part of its surface coated with a silical gel, which comprises adding silica sol to the tobacco raw material and subjecting the silical gel to gelation.

23 Claims, 1 Drawing Sheet

TOBACCO RAW MATERIAL AND METHOD FOR ITS PRODUCTION

BACKGROUND OF THE INVENTION

Field of the Invention

The present invention relates to a tobacco raw material, particularly a tobacco raw material having high filling capacity, and methods for its production.

Description of Related Art

In recent years, consumers' preference for cigarettes has changed to cigarettes having mild taste and aroma and low nicotine and tar in the smoke thereof. As a means for producing such mild cigarettes, it is most effective to reduce the weight of cut-rug in the cigarette. However, in order to prevent deformation during production or smoking, and to satisfy consumers' desire for smooth smoking, a certain cigarette firmness is required. Accordingly, a tobacco raw material which provides a certain cigarette firmness with a lower amount (high filling capacity) is necessary.

As a method, for the standard specification of cigarettes, to reduce the weight of cut-rug in cigarette rods required to obtain a certain cigarette firmness (hereinafter referred to as "net filling weight"), an expansion treatment utilizing the expansion pressure of an impregnated agent having a low boiling point at vaporization by heating, a method to decrease the apparent density of cut-rug by a freeze-dry treatment, and a method to improve the elasticity of cut-rug by adding an additive, are well known.

Although these expansion treatments and freeze-dry treatment provide useful effects, they have such drawbacks that cigarettes subjected to these treatments are inferior in aroma and taste of the tobacco smoke, and the burning rate is too rapid as well. Furthermore, environmental pollution by the agent contained in the gas exhausted during the expansion treatment and high treatment cost required in the freeze-dry treatment have become serious problems. On the other hand, many attempts to improve the elasticity by adding various additives have been reported, and an organic compound is used in almost all attempts, whereby neither aroma and taste of tobacco smoke nor effects are unsatisfactory.

So called cut-rug obtained by cutting leaf tobacco is used for the usual tobacco for cigarettes. During the step to cut leaf tobacco or other steps to produce cigarettes, tobacco waste such as waste leaf tobacco, cut leaf tobacco, powder tobacco and stem waste are produced. To utilize these tobacco wastes efficiently, the tobacco wastes have been re-used as a raw material for cigarettes by fabricating them into a sheet, followed by cutting and blending to obtain cut-rug. This reconstituted product in the form of a sheet is called sheet tobacco.

As processes for producing sheet tobacco, the following three processes are known.

Roll Process

To tobacco waste in the form of a powder, a binder, a burning regulator, a humectant, a flavor agent, etc. are optionally blended to obtain a powder mixture. After its water content is adjusted to about from 30 to 70%, the powder mixture is supplied to a pair of rollers to form a sheet.

Paper Process

Tobacco waste is extracted with water and the extract is separated from the fibrous residue of tobacco. The fibrous residue is sheeted by a paper machine to form a base sheet, and the concentrated extract is returned to the base sheet.

Slurry Process

The same tobacco waste as in process (1) is finely pulverized and a slurry having a water content of from 400 to 700% is prepared. The slurry is injected into a thin layer on a belt made of stainless steel to form a sheet.

Sheet tobacco formed by above processes has the drawbacks that in processes (1) and (3), the sheet structure becomes dense because tobacco waste is finely pulverized, and in process (2), the sheet is stretched because a large amount of water is used during the formation of the base sheet, whereby the filling capacity is low in each case. Under these circumstances, there have been various investigations into additives such as a binder for tobacco, and there have been some proposals. For example, Japanese Examined Patent Publication No. 45914/1985 has proposed that in a method for producing sheet tobacco by the roll process, from 4 to 10% of an $\alpha$-starch and hydrolyzed starch having a molecular weight of from 100,000 to 900,000 can be added to form wrinkles on the sheet tobacco, whereby the filling capacity is improved.

SUMMARY OF THE INVENTION

Accordingly, it is an object of the present invention to find means to efficiently reduce the amount of leaf tobacco and to provide tobacco raw material having a great filling capacity and a method for its production.

Specifically, the present invention provides a tobacco raw material having at least a part of its surface coated with silica gel and a method for producing a tobacco raw material having at least a part of its surface coated with silica gel, which comprises adding a silica sol to the tobacco raw material and subjecting the silica gel to gelation or subjecting a silicon alkoxide to hydrolysis on the surface of the tobacco raw material to form the silica gel.

Furthermore, the present invention provides cigarettes made of the tobacco raw material having at least a part of its surface coated with silica gel and sheet tobacco having a part of its components substituted by silica gel dispersed therein.

DETAILED DESCRIPTION OF THE PREFERRED EMBODIMENTS

Figure 1:
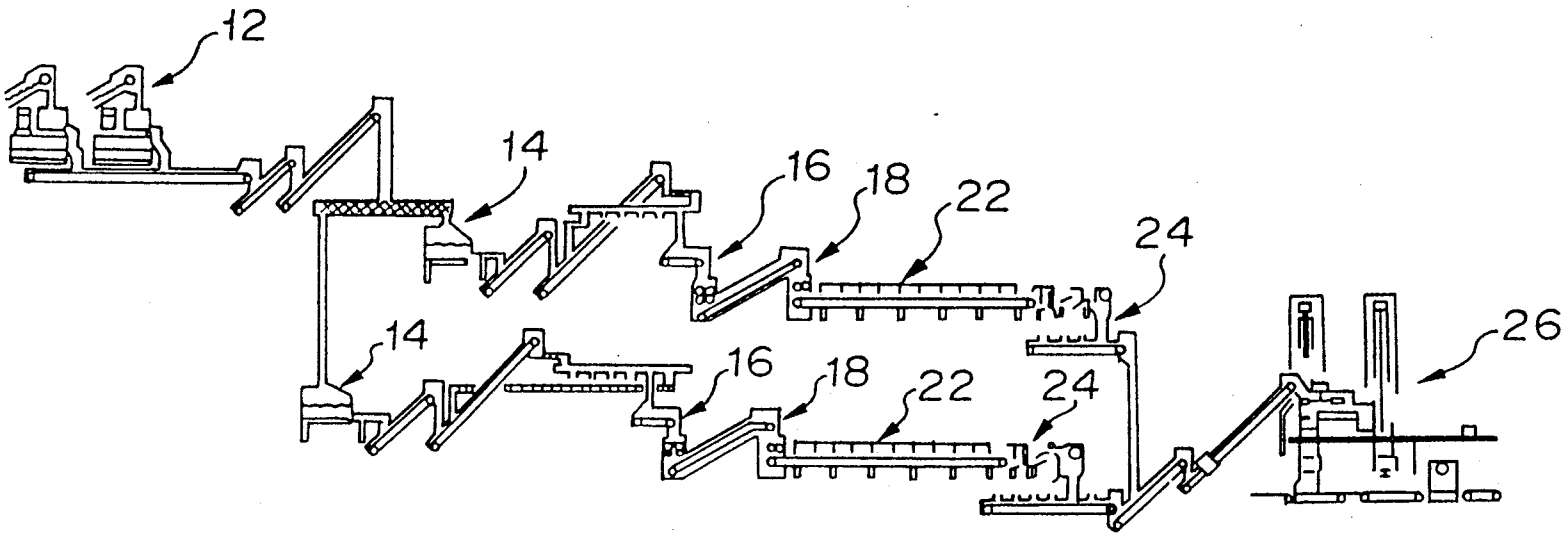
FIG. 1 illustrates a roll process for producing sheet tobacco.

Now, the present invention will be described in detail with reference to the preferred embodiments.

The tobacco raw material referred to here means not only leaf tobacco which is not cut and leaf tobacco which is cut into cut-rug form, but also sheet tobacco which is reconstituted from tobacco wastes and tobacco raw material obtained by shredding the reconstituted sheet tobacco.

There is no particular restriction as to the silica gel coated on the surface of the tobacco raw material unless it is poisonous or it generates a poisonous gas or strange odor or offensive smell during the burning of the tobacco raw material.

The amount of silica gel used in the present invention is preferably within a range of from 1 to 30% by weight added to the tobacco raw material. If the amount added is less than 1% by weight, the desired object cannot be efficiently attained, such being undesirable. On the other hand, if it exceeds 30% by weight, the burning of tobacco is hindered, whereby smooth smoking would be difficult, such being undesirable. More preferably, it is within a range of from 1 to 15% by weight.

The case where the silica gel is coated thinly and uniformly on the surface of the tobacco raw material is preferred because great filling capacity of the tobacco raw material can be obtained with a lower amount of silica gel. The thickness of the coated layer is preferably within a range of about from 0.1 to 5 μm.

As the method for forming a silica gel coating layer on the tobacco raw material, a colloidal solution of silica such as a silica sol is coated on the tobacco raw material and subjected to gelation by drying. This method is preferred because a uniform and thin silica gel coating layer can be readily obtained.

As the silica sol used in the present invention, a silica sol having a concentration of from 2 to 30% by weight $SiO_2$ solid content is preferably used. If the concentration is less than 2% by weight, effective reinforcement of the tobacco raw material cannot be expected, such being undesirable. On the other hand, if it exceeds 30% by weight, the viscosity of the silica colloidal solution is high, whereby it is difficult to add the silica sol uniformly during the treatment, such being undesirable. Preferably, the $SiO_2$ concentration is within a range of form 9 to 15% by weight.

It is considered that the reinforcing effect is increased by repeating the coating and drying steps with a silica sol having a low $SiO_2$ concentration, but this is not preferred because the taste, color, etc. of the tobacco would be spoiled.

The pH value of the silica sol used in the method of the present invention is preferably adjusted to about neutrality (pH=5-8). If the pH value is less than 5, the gelation of the silica sol tends to readily proceed, such being undesirable. If the pH value exceeds 8, the properties or color of the tobacco raw material would be changed, such being undesirable. To adjust the pH value, it is appropriate to use a compound which is harmless and does not cause rapid gelation of the silica sol, for example, acetic acid or aqueous ammonia.

As to the particle size of the silica sol particle, a finer particle is preferred because a uniform silica coating layer can be obtained. The particle size of the sol particle is preferably at most 150 Å.

In the method of the present invention, a silica sol in which the silica particles are linked to one another in a chain structure has a viscosity suitable for coating with a lower solid content as compared with monodispersed silica sol. Therefore, when it is coated on the surface of the tobacco raw material, a uniform and thin silica coating layer can be obtained, whereby the reduction in the amount of the tobacco raw material is great. Although the conditions for providing a silica sol wherein the silica particles are linked to one another in a chain structure cannot be determined specifically, it is mainly affected by the amount of deflocculant. Namely, silica sol wherein the silica particles are linked to one another in a chain structure is characterized by having a lower amount of deflocculant as compared with monodispersed silica sol. Such a structure of the silica sol can be confirmed by dropping a diluted solution of the silica sol on, for example, a collodion film, and drying the solution followed by observation by means of a transmission electron microscope.

There is no particular restriction as to the process for producing the silica sol used in the method of the present invention. Depending on the physical properties of the sol to be used, various known processes can be adopted. For example, a representative process is one wherein a silicate solution obtained by removing an alkali ion from an alkali silicate solution by ion exchange or electrodialysis is dropped into an alkali silicate solution, whereby silica colloidal particles gradually grow. Further, a process wherein an alkali silicate solution is neutralized with an acid to form a silica colloid particle and a deflocculant is added thereto to obtain a stable silica sol, and a process wherein a silicon alkoxide is subjected to hydrolysis, can be also adopted.

There is no particular restriction as to the means for coating the silica sol on the tobacco raw material, and, for example, the tobacco raw material can be dipped in the silica sol solution, or the silica sol solution can be sprayed onto the tobacco raw material. Particularly, the latter method is preferred because the amount to be sprayed onto the tobacco raw material can be readily controlled. There is no particular restriction as to the form of the tobacco raw material to be treated, and it is treated in the form of lamina or in the form of shreds after cutting. The tobacco raw material in the form of shreds can be treated more uniformly.

The tobacco raw material coated with the colloidal silica solution in the above-mentioned manner is dried at from 60° to 70° C. and subjected to moisture conditioning in accordance with conventional procedures. Then, it is supplied to a step for producing cigarettes. If the drying temperature is less than 60° C., a long period of time is required for drying, such being undesirable. On the other hand, if the drying temperature exceeds 70° C., the aroma and taste of tobacco smoke of tobacco would be spoiled, such being undesirable.

As a method to produce a tobacco raw material having silica gel coated on the surface, a method wherein a silicon alkoxide (alkyl silicate) is subjected to hydrolysis on the surface of the tobacco raw material to convert it to silica can be also adopted. As the silicon alkoxide, silicon alkoxide having a carbon number of from 1 to 3, for example, silicon methoxide (methyl silicate) and silicon ethoxide (ethyl silicate) may be mentioned. Among them, ethyl silicate is preferably used.

In the method of the present invention, it is appropriate that the silicon alkoxide is used as a solution having a concentration of from 5 to 60% by weight as the $SiO_2$ concentration by diluting with a solvent such as ethanol. If the concentration is less than 5% by weight, it is difficult to obtain the primary object of reinforcing effect, such being undesirable. On the other hand, if the concentration exceeds 60% by weight, the compatibility of the alkoxide with water decreases, whereby hydrolysis would not proceed sufficiently, such being undesirable.

It is preferred that the hydrolysis of silicon alkoxide proceed immediately. Thus, it is desirable to use a hydrolysis promoting agent. As the hydrolysis promoting agent, an agent which produces a rapid hydrolysis rate and which does not remain in the leaf tobacco after the hydrolysis is desirable. Specifically, an ammonia component is used. The ammonia component is used in the form of, for example, ammonia, aqueous ammonia or an ammonium carbonate. It is appropriate that the ammonia component is used as a solution having a concentration of from 0.01 to 5% by weight as $NH_3$ concentration by diluting with, for example, water or ethanol. If the concentration is less than 0.01% by weight, it takes a long period of time to conduct hydrolysis, whereby the hydrolysis promoting effect will be insufficient and the properties of the leaf tobacco would be changed, such being undesirable. On the other hand, if the concentration exceeds 5% by weight, the properties of leaf tobacco would be changed, such being undesirable.

Water required to conduct the hydrolysis should exist in at least either of the ammonia component or the silicon alkoxide. However, it is preferred to have water present in both because the compatibility of the alkoxide with water is improved and the hydrolysis proceeds rapidly. Strictly speaking, the amount of water required in the hydrolysis depends on the type of the silicon alkoxide to be used. However, generally speaking, the amount of water to be required is about from 1.1 to 3 times the theoretical amount required to conduct 100% hydrolysis of the silicon alkoxide.

As to the means to add the silicon alkoxide and the ammonia component to the tobacco raw material, there is no particular restriction, and appropriate means can be adopted. For example, each solution can be placed in a separate container and the leaf tobacco impregnated in the containers alternately, or each solution can be sprayed onto the leaf tobacco. Although the order in which to add these solutions to the tobacco raw material is not restricted, the order where the ammonia component is added and then the silicon alkoxide is added is preferred because the hydrolysis is conducted rapidly and efficiently. The leaf tobacco having both solutions added is then put into a closed container, and the temperature is kept at from 60° to 70° C. for about from 4 to 10 hours to conduct hydrolysis, whereby the silicon alkoxide is converted to silica gel.

If the reaction temperature and time are less than the above ranges, the hydrolysis will be insufficient, such being undesirable. On the other hand, if they exceed the above ranges, the components in the leaf tobacco will volatilize or the color would be changed, such being undesirable.

There is no particular restriction as to the form of leaf tobacco to be treated. The leaf tobacco treated in the form of lamina is subjected to cutting or the leaf tobacco in the form of shreds after cutting is subjected to the treatment. The leaf tobacco in the form of shreds is preferably used because it can be treated more uniformly.

The tobacco raw material having the silica gel added is dried, for example, at from 60° to 70° C., and subjected to moisture conditioning in accordance with conventional procedures. Then, it is supplied to the conventional steps for producing cigarettes.

If cigarettes made of the leaf tobacco of the present invention is lighted and left on an ashtray, it will shortly extinguish because of its low burning rate. Thus, cigarettes according to the present invention have the advantage that fires because of smoking in bed can be prevented, and side streams generated during smoldering on an ashtray can be efficiently suppressed.

Furthermore, in conventional cigarettes, the butt of the cigarette becomes soft during smoking because the moisture content and temperature of the cigarette rod are increasing during burning, whereby a smoker feels unpleasant. By using the leaf tobacco according to the present invention, such phenomena do not occur, such being advantageous.

Further, the decrease in the amount of raw materials necessary results in considerable economical benefits.

The present invention further provides sheet tobacco reinforced by silica gel. The present invention can be used in all of the processes mentioned above. The roll process will be described in detail as follows.

As shown in FIG. 1, the raw material of tobacco waste powder is mixed with auxiliary components such as an appropriate reinforcing agent, a humectant, a water resistance agent and a binder in a batch type blender 12, and granulated into a wetting powder having a water content of about 30%. The granulate thus obtained is distributed uniformly to a constant-amount feeder 14 in each line. In each line, the above granulate is kneaded continuously in a kneader 16 and formed into a sheet by a pair of rollers type forming apparatus 18. Then, the product in the form of a sheet is dried by a heater or hot air during conveying by a mesh conveyer 22, and is roughly cut by a cutter 24 into a dimension for physical distribution. Finally, sheet tobacco product treated in each line is gathered and packed by using a package machine 26.

The proportions of sheet tobacco components in the above wetting granulate are usually from 50 to 80% by weight of tobacco waste such as tobacco fine powder or stem waste, from 5 to 15% by weight of reinforcing agent such as fibrous pulp, from 5 to 15% by weight of humectant such as propylene glycol, from 1 to 5% by weight of water resistance agent such as glyoxal, and from 1 to 5% by weight of a binder such as sodium carboxy methyl cellulose. However, there is no particular restriction.

In order to reinforce sheet tobacco with silica gel, a silica sol is preliminarily blended with tobacco waste in the form of powder in a blender 12. In this case, a bonding structure of the silica gel is formed in the sheet tobacco, whereby the strength can be improved. The silica sol added to the sheet tobacco is, for example, converted to silica gel on mesh conveyer 22 while the sheet is dried by a heater or hot air.

As the silica sol to be used for reinforcing sheet tobacco, the same silica sol as used for the tobacco raw material as mentioned above can be used. The amount added is preferably an amount which substitutes from 1 to 50% by weight of the sheet tobacco as $SiO_2$. If the substitution amount is less than 1% by weight, the reinforcing effect for the sheet tobacco would not result, such being undesirable. On the other hand, if it exceeds 50% by weight, the burning of the tobacco would be prevented, such being undesirable.

Now, the present invention will be described in further detail with reference to Examples. However, it should be understood that the present invention is by no means restricted by such specific Examples.

EXAMPLE 1

To 100 parts by weight of a monodispersed silica sol having an $SiO_2$ concentration of 30% by weight using water as a solvent, 3.8 parts by weight of acetic acid were added to obtain a silica sol solution adjusted to have a pH of 7.0. 692 g of the silica sol thus obtained were sprayed uniformly onto 1,800 g of blended cut-rug for production of cigarettes in a closed container and dried at 60° C. under such conditions that no drying mark appears, until the water content became 10%, whereby cut-rug having an $SiO_2$ content in the product (hereinafter referred to as "$SiO_2$ substitution rate") of 10% by weight was obtained. The treated cut-rug thus obtained was kept under a relative humidity of 60% for 5 days for conditioning and then run through a cigarette making machine to obtain cigarettes having a length of 70 mm and a circumference of 25 mm.

The firmness of the cigarettes thus obtained was measured by means of a measuring apparatus and the amount of cut-rug required to obtain a desired cigarette firmness was determined. Further, by using an automatic smoking machine, nicotine, tar and CO yields in the mainstream smoke of cigarettes were measured under standard smoking conditions (2 second 35 cc puff once per minute, butt length 30 mm). Furthermore, the change of cigarette firmness of the non-burnt portion before and after smoking (heat softening degree) was determined.

Specifically, cigarettes were placed horizontally, and 143 g of load by a 10×10 mm compression plate was exerted at a position 35 mm from the top of the cigarette for one second just after one puff, whereby the heat softening degree of the cigarette was calculated from the compression deflection by using the following formula:

$$\text{Heat softening degree} = ((D_0 - D_1)/D_0) \times 100$$

$D_0$: the height of the compression plate at a position 35 mm from the top before smoking $D_1$: the height of the compression plate at the point 35 mm from the top after smoking The reduction rate (% by weight) was calculated as follows:

$$\text{Reduction rate} = ((h_1 - h_0)/h_1) \times (100 - S)$$

$h_0$: compressed height of untreated leaf tobacco $h_1$: compressed height of treated leaf tobacco S: $SiO_2$ substitution rate (% by weight)

The compressed height was obtained by filling 15.0 g of cut-rug in a cylinder having an inner diameter of 70 mm, exerting 250 g/cm$^2$ of pressure for 2 minutes, and measuring the thickness of the layer of the pressed cut-rug.

The results thus obtained are shown in Table 1, with the non treated product being 100.

TABLE 1

| Measuring item | Non-treated product | Treated product |
|---|---|---|
| Net filling weight | 100 | 94 |
| Tar yield in the mainstream | 100 | 86 |
| Nicotine yield in the mainstream | 100 | 94 |
| CO yield in the mainstream | 100 | 93 |
| Heat softening degree | 100 | 94 |

It is evident from Table 1 that by using treated cut-rug according to the present invention, cigarettes having the standard firmness can be obtained with 16% (decrease of the net filling weight 6%+decrease of $SiO_2$ substitution rate 10%) less cut-rug than the non-treated product.

Further, the nicotine, tar and CO yields in the mainstream smoke of cigarettes were reduced by 14, 6 and 7%, respectively. According to the method of the present invention, it was possible to improve the softening of butt during smoking. The aroma and taste of the tobacco smoke of cigarettes using the treated cut-rug were milder than those of the non-treated product, and no defects due to the treatment was observed.

EXAMPLE 2

To 100 parts by weight of a monodispersed silica sol having an $SiO_2$ concentration of 20% by weight using water as a solvent, 3.8 parts by weight of acetic acid (10% by weight of aqueous solution) were added to adjust the pH to 7.0. This silica sol was diluted with water to have about 0.1% by weight of concentration as solid content. The silica sol aqueous solution was dropped and dried on a collodion film, and observed with a transmission electron microscope, whereby all the silica particles were found to be dispersed.

182.17 g of the silica sol thus obtained was sprayed uniformly onto 550 g of leaf tobacco in a closed container and dried at 60° C. under such a condition that no drying mark appears, until the weight became 685.1 g. The leaf tobacco thus obtained was further kept at 22°. C. and a relative humidity of 60% for 5 hours.

The same measurements as in Example 1 were conducted, whereby the $h_1$, $h_0$, $SiO_2$ substitution rate and reduction rate were 15.0 mm, 14.7 mm, 6% and 7.9%, respectively.

EXAMPLE 3

To 100 parts by weight of a silica sol having an $SiO_2$ concentration of 20% by weight using water as a solvent, 5.0 parts by weight of acetic acid (10% by weight of aqueous solution) were added to adjust the pH to 7.0. The silica sol thus obtained was diluted with water to have about 0.1% by weight of concentration as solid content. This silica sol solution was dropped and dried on a collodion film, and observed by a transmission electron microscope, whereby silica parties of the silica sol were found to be linked to one another in a chain structure.

184.31 g of this silica sol was sprayed uniformly onto 550 g of leaf tobacco in a closed container, and dried at 60° C. under such condition that no drying mark appears, until the weight became 585.1 g. The leaf tobacco thus obtained was further kept at 22° C. under a relative humidity of 60% for 5 hours.

The $h_1$, $t_0$, $SiO_2$ substitution rate and reduction rate of the leaf tobacco treated in the above manner were 16.0 mm, 14.7 mm, 6% and 13.6%, respectively.

Further, the leaf tobacco was cut off standard size and made into cigarettes having a length of 70 mm and a circumference of 25 mm by a cigarette making machine, and the change of the cigarette firmness of the non-burnt portion of the cigarette before and after smoking was measured. The heat softening degree of the treated product was 94% of that of the non-treated tobacco.

EXAMPLE 4

393.75 g of the silica sol solution as used in Example 3 was sprayed uniformly onto 550 g of leaf tobacco, and dried at 60° C. until the weight became 625.0 g. Further, the leaf tobacco was kept at 22° C. under a relative humidity of 60% for 5 hours.

Measurement was conducted as in Example 1, and the $h_1$, $h_0$, $SiO_2$ substitution rate and a reduction rate were 17.3 mm, 14.7 mm, 12% and 25.2%, respectively.

The heat softening degree of the treated product was 91% of that of the non-treated tobacco.

EXAMPLE 5

To 100 parts by weight of silica sol having an $SiO_2$ concentration of 10% by weight using water as a solvent, 2.5 parts by weight of acetic acid (10% aqueous solution) was added to adjust the pH to 7.0. The silica sol was observed in the same manner as in Example 3, and the silica particles of the silica sol were found to be linked to one another in a chain structure. 359.84 g of this silica sol solution was sprayed uniformly onto 550 g of leaf tobacco, and dried at 60° C. until the weight became 585.1 g. Further, it was kept at 22° C. under a relative humidity of 60% for 5 hours.

Measurement was conducted as in Example 1, and $h_1$, $h_0$, $SiO_2$ substitution rate and reduction rate were 16.4 mm, 14.7 mm, 6% and 15.7%, respectively.

EXAMPLE 6

1,800 g of blended cut-rug for production of cigarettes was weighed and 450 g of a 14% by weight ammonium carbonate aqueous solution was sprayed thereto. The cut-rug was allowed to stand to uniformly disperse.

Then, 1,045 g of an ethyl silicate solution obtained by adding 4.46 parts by weight of water to 100 parts by weight of a 20% by weight ethyl silicate solution as $SiO_2$ concentration using ethanol as a solvent was sprayed uniformly onto the cut-rug in a closed container and allowed to stand for 6 hours while the container was closed.

The cut-rug was taken out from the container and dried at 60° C. under such condition that no drying mark appears, until the water content became 10%, whereby the cut-rug having an $SiO_2$ substitution rate of 10% was obtained.

After the cut-rug was kept and matched at 22° C. under a relative humidity of 60% for 5 days, it was made into cigarettes having a length of 70 mm and a circumference of 25 mm by a cigarette making machine. With respect to the cigarette, measurement as in Example 1 was conducted and the results thus obtained are shown in Table 2, with the non-treated product being 100.

TABLE 2

| Measuring item | Non-treated product | Treated product |
|---|---|---|
| Net filling weight | 100 | 95 |
| Heat softening degree | 100 | 85 |
| Puff count | 100 | 107 |

It is evident from Table 2 that by using the treated cut-rug treated according to the present invention, the standard firmness of the cigarette can be obtained with 15% (decrease of the net filling weight 5%+decrease of $SiO_2$ substitution rate 10%) less cut-rug than that of the non-treated product. Further, the heat softening degree during smoking was suppressed by 15% by the treatment according to the present invention. Furthermore, the puff count increased by 7%, whereby such drawback that the burning rate becomes too fast when the net filling weight is reduced can be improved. The aroma and taste of the tobacco smoke of the cigarette using the treated cut-rug was milder than that of the non-treated product, and no defect due to the treatment was observed.

EXAMPLES 7-12

To a tobacco raw material having a composition as shown in Table 3, a silica sol as shown in Table 4 was added and kneaded to produce sheet tobacco in accordance with the process shown in FIG. 1.

TABLE 3

| Component | Composition (% by weight) |
|---|---|
| Tobacco waste powder | 43.6 |
| Stem waste powder | 14.5 |
| Reinforcing agent (fibrillated pulp) | 8.7 |
| Binder (CMC) | 1.7 |
| Humectant (propylene glycol) | 6.5 |
| Flavor | 22.1 |
| Water resistance agent (Glyoxal) | 2.9 |
| Total | 100 |

TABLE 4

| | Sol concentration (% by weight) | Property of Sol | Addition timing | Addition amount of Silica (% by weight) |
|---|---|---|---|---|
| Example 7 | 30 | Mono-dispersed | Just after neutralization | 3 |
| 8 | 30 | Mono-dispersed | Just after neutralization | 6 |
| 9 | 30 | Mono-dispersed | Just after neutralization | 9 |
| 10 | 20 | Fibrous | Just after neutralization | 5 |
| 11 | 20 | Fibrous | Just after neutralization | 9 |
| 12 | 20 | Fibrous | 30 minutes after neutralization | 5 |
| Comparative Example 1 | — | — | — | 0 |

The tensile strength, filling capacity and heat softening degree of the sheet tobacco were measured.

The tensile strength was obtained from the stress at the time of breaking by stretching a sheet tobacco sample having an effective length of 50 mm and width of 15 mm by means of a constant-speed tensile testing machine.

The filling capacity was obtained by filling 15 g of shredded sheet tobacco sample (usual form of tobacco raw material for cigarette) uniformly in a cylinder having an inner diameter of 70 mm, and measuring the bulk density of the sample at a compression stress of 250 $g/cm^2$ while compressing by a piston with a constant speed (30 mm/min). Specifically, the smaller the value, the greater the filling capacity, such being desirable.

The results of the measurements are shown in Table 5.

TABLE 5

| | Sol concentration (% by weight) | Tensile strength | Filling capacity | Heat softening degree |
|---|---|---|---|---|
| Example 7 | 3 | 115 | 100 | — |
| 8 | 6 | 124 | 98 | — |
| 9 | 9 | 129 | 97 | — |
| 10 | 5 | 112 | 91 | 91 |
| 11 | 9 | 106 | 82 | 82 |
| 12 | 5 | 111 | 84 | 84 |
| Comparative Example 1 | 0 | 100 | 100 | 100 |

By using the tobacco raw material treated with the method of the present invention, cigarettes having the standard cigarette firmness can be obtained with less weight, and heat softening at the butt during smoking can be prevented. Accordingly, by using the present invention, cigarettes having a mild taste can be produced with low cost.

What is claimed is:

1. A method for producing a tobacco raw material having at least a part of its surface coated with a layer of silica gel, which comprises adding a silica sol to said tobacco raw material and subjecting the silica gel to gelation.

2. The method according to claim 1, wherein silica particles of said silica sol are linked to one another in a chain structure.

3. The method according to claim 1, wherein said tobacco raw material is a member selected from the group consisting of uncut leaf tobacco, leaf tobacco cut into cut-rug form, sheet tobacco reconstituted from tobacco wastes, and tobacco raw material obtained by shredding reconstituted sheet tobacco.

4. The method according to claim 1, wherein the amount of said silica gel is within a range of from 1 to 30% by weight of said tobacco raw material.

5. The method according to claim 4, wherein the amount of said silica gel is within a range of from 1 to 30% by weight of said tobacco raw material.

6. The method according to claim 1, wherein said silica gel is coated thinly and uniformly on said surface.

7. The method according to claim 4, wherein the thickness of said layer of silica gel is within the range of from about 0.1 to 5 μm.

8. The method according to claim 1, wherein said silica sol is a colloidal solution of silica.

9. The method according to claim 1, wherein said gelation is accomplished by drying.

10. The method according to claim 1, wherein said silica sol has a concentration of from 2 to 30% by weight $SiO_2$.

11. The method according to claim 10, wherein said silica sol has a concentration of from 9 to 15% by weight $SiO_2$.

12. The method according to claim 1, wherein said silica sol has a pH of about neutrality.

13. The method according to claim 12, wherein said silica sol has a pH of about 5 to 8.

14. The method according to claim 1, wherein the pH of said silica sol is adjusted with a compound which is harmless and does not cause rapid gelation of said silica sol.

15. The method according to claim 14, wherein said compound is acetic acid or aqueous ammonia.

16. The method according to claim 1, wherein said silica sol has a particle size of at most 150 Å.

17. The method according to claim 1, wherein said silica sol is produced by removing alkali ions from a solution of an alkali silicate by ion exchange or electrodialysis, and dropping the resulting silicate solution into an alkali silicate solution, thereby forming colloidal particles of silica.

18. The method according to claim 1, wherein said silica sol is produced by neutralizing an alkali silicate solution with an acid to form colloidal particles of silica, and then adding a deflocculant thereto to obtain a stable silica sol.

19. The method according to claim 1, wherein said silica sol is produced by subjecting a silicon alkoxide to hydrolysis.

20. The method according to claim 1, wherein said adding said silica sol is accomplished by dipping said tobacco raw material in said silica sol solution.

21. The method according to claim 1, wherein said adding said silica sol is accomplished by spraying said silica sol onto said tobacco raw material.

22. The method according to claim 1, wherein said tobacco raw material is treated in the form of lamina, or in the form of shreds after cutting.

23. The method according to claim 1, wherein said tobacco raw material coated with said silica sol is dried at a temperature of from 60° to 70° C. and subjected to moisture conditioning in accordance with conventional procedures.

* * * * *